United States Patent [19]

Watanabe

[11] Patent Number: 4,652,113

[45] Date of Patent: Mar. 24, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 798,611

[22] Filed: Nov. 15, 1985

[30] Foreign Application Priority Data

Nov. 21, 1984 [JP] Japan ..... 59-246515

[51] Int. Cl.[4] ..... G03G 15/01; G03G 15/08

[52] U.S. Cl. ..... 355/3 DD; 355/14 D; 355/4

[58] Field of Search ..... 355/3 DD, 14 D, 4, 3 R; 118/653; 430/120, 121

[56] References Cited

U.S. PATENT DOCUMENTS

| | | | |
|---|---|---|---|
| 3,795,917 | 3/1974 | Yamaji et al. | 355/4 |
| 3,970,042 | 7/1976 | Rees | 355/4 X |
| 3,987,756 | 10/1976 | Katayama et al. | 355/4 X |
| 4,097,139 | 6/1978 | Hauser et al. | 355/4 |
| 4,165,165 | 8/1979 | Iwami et al. | 355/4 |
| 4,255,040 | 3/1981 | Weiel et al. | 355/3 R |
| 4,571,071 | 2/1986 | Bothner | 355/4 X |

*Primary Examiner*—A. C. Prescott

*Attorney, Agent, or Firm*—Oblon, Fisher, Spivak, McClelland & Maier

[57] ABSTRACT

An image forming apparatus is provided with a developing unit for developing a latent image on the surface of a photosensitive drum. The developing unit includes at least two developing devices which alternatively develop the latent image, and a supporting mechanism for supporting the developing devices while keeping the developing devices parallel to each other, and for selectively causing one of the developing devices to oppose the photosensitive drum. The supporting mechanism includes a rotating member rotatable about a first rotating shaft, the rotating member supporting the developing devices to be rotatable about a plurality of second rotating shafts disposed around the first rotating shaft, a stationary pulley fixed to the rotating member so as to be coaxial with the first rotating shaft, a revolving pulley fixed to each of the developing devices so as to be coaxial with each of the second rotating shaft, and toothed belts looped between the revolving pulleys and the stationary pulley.

6 Claims, 26 Drawing Figures

IMAGE FORMING APPARATUS

BACKGROUND OF THE INVENTION

The present invention relates to an image forming apparatus such as a copying machine which can select a desired color copying operation with which to perform color imaging.

In recent years, copying machines have been proposed which can form copy images having different colors by replacing different color developing devices or units including a developing device with other such devices or units. However, in such copying machines, replacement of the developing devices or units is very cumbersome, resulting in inconvenience. Thus, copying machines having the arrangement shown in FIGS. 1 to 6 have been proposed.

Referring to FIG. 1, reference numeral 1 denotes a photosensitive drum. A developing unit 2 is disposed adjacent to the drum 1. The unit 2 comprises developing device receptors 3*a* to 3*d*, also shown in FIG. 2. Developing devices 4*a* to 4*d* are respectively set in the receptors 3*a* to 3*d*. The devices 4*a* to 4*d* store toners of different colors. The receptors 3*a* to 3*d* are provided on a cross-shaped rotating frame 5, as shown in FIGS. 3 and 4. A stationary gear 6 is coaxially fixed to the frame 5, and the frame 5 is rotatable about the center of the gear 6. Four planet gears 7*a*, 7*b*, 7*c* and 7*d* are axially and rotatably supported at middle portions of respective stems of the frame 5 while meshing with the stationary gear 6. Four other planet gears 8*a*, 8*b*, 8*c* and 8*d* are rotatably arranged at the distal ends of the respective stems of the frame 5 while meshing with the corresponding gears 7*a*, 7*b*, 7*c* and 7*d*. The receptors 3*a* to 3*d* are fixed to rotating shafts 9*a* to 9*d* of the outer gears 8*a* to 8*d*, respectively.

The gears 7*a*, 8*a*, 7*b*, 8*b*, 7*c*, 8*c*, 7*d* and 8*d* have the same number of teeth. Since the gear 6 is fixed to the frame 5, even if the frame 5 is rotated the gears 8*a* to 8*d* are not rotated about the axes thereof. For this reason, the receptors 3*a* to 3*d* (the devices 4*a* to 4*d*) are revolved around the gear 6 and kept parallel to each other. Thus, one developing device (e.g., the device 4*d*) selectively opposes the drum 1. Note that the frame 5 is rotated by a motor 12 through a deceleration means such as gears 10 and 11.

The developing unit 2 is movable along a direction such that it can approach and move away from the drum 1 by means of a moving mechanism (not shown). In the copy mode, as shown in FIG. 1, the selected developing device, e.g., 4*b* is set to face the drum 1. When selection of one of the devices 4*a* to 4*d* is being made, the unit 2 is moved to a position separated by a given distance from the drum 1. When a desired developing device has been selected, the unit 2 is once again moved toward the drum 1.

The devices 4*a* to 4*d* have developing device gears 14*a* to 14*d* and idle gears 15*a* to 15*d* for driving developing rollers 13*a* to 13*d*, respectively, while the devices 4*a* to 4*d* are themselves driven by a drive gear 16 provided at the side of the housing (not shown). When the unit 2 approaches the drum 1, the drive gear 16 is meshed with, e.g., the idle gear 16*b*, and a drive force is transmitted to the gear 14*b* through the gears 16 and 15*b*.

Guide members 17*a* to 17*d* (only members 17*b* and 17*c* are shown) are fixed to the receptors 3*a* to 3*d*, respectively. A guide pin 18 is fixed to the housing side. The members 17*a* to 17*d* can be engaged with the pin 18. Thus, when the unit 2 approaches the drum 1, the selected developing device can be smoothly and precisely guided to obtain a precise positional relationship between the drum 1 and the selected developing device.

However, with the above arrangement, when the devices 4*a* to 4*d* are revolved and kept parallel to each other, the gears 6, 7*a* to 7*d* and 8*a* to 8*d* are used as a selection means for selecting one developing device to oppose the drum 1. For this reason, the devices 4*a* to 4*d* cannot be smoothly revolved, thus causing noise, backlash and the like.

SUMMARY OF THE INVENTION

The present invention has been made in consideration of the above situation, and has as its object to provide an image forming apparatus which can smoothly replace developing devices and is free from noise, backlash and the like.

In order to achieve the above object, there is provided an image forming apparatus comprising at least two developing devices provided in a housing, and a supporting means for supporting the developing devices while keeping them parallel to each other, and for selectively causing one of the developing devices to oppose the image carrier wherein the supporting means is constituted by a rotating member rotatable about a first rotating shaft, said rotating member supporting said developing devices to be rotatable about a plurality of second rotating shafts disposed around said first rotating shaft, a stationary pulley fixed to said rotating member to be coaxial with said first rotating shaft, a revolution pulley fixed to each of said developing devices to be coaxial with each of said second rotating shaft, and toothed belts looped between said revolution pulleys and said stationary pulley.

BRIEF DESCRIPTION OF THE DRAWINGS

FIGS. 1 to 6 show the prior art apparatus, in which:

FIG. 1 is a longitudinal, sectional view showing a developing unit;

FIG. 2 is a sectional view showing receptors of the developing unit;

FIG. 3 is a front view of a rotating arm;

FIG. 4 is a longitudinal, sectional, side view of the developing unit; and

FIGS. 5 and 6 are longitudinal sectional views illustrating the alignment mechanism of developing devices and its drive mechanism which aligns the developing devices with respect to a photosensitive drum, FIGS. 7 to 19 show one embodiment of the image forming apparatus according to the present invention, in which:

FIG. 7 is a front view schematically showing the main part of the present invention;

FIG. 8 is a perspective view of the multicolor copying machine of said one embodiment;

FIG. 9 is a longitudinal, sectional, front view schematically showing a copy mode of the multicolor copying machine;

FIG. 10 is a longitudinal, sectional, front view schematically showing a developing device selection mode of the multicolor copying machine;

FIG. 11 is a longitudinal, sectional view of a developing unit;

FIG. 12 is a sectional view showing receptors of the developing unit;

FIG. 13 is a view showing a rotating arm;

FIG. 14 is a longitudinal, sectional side view of the developing unit;

FIGS. 15 and 16 are longitudinal sectional views illustrating the alignment mechanism of developing devices and its drive mechanism which aligns the developing devices with respect to a photosensitive drum;

FIG. 17 is a perspective view illustrating the structure of a timing belt;

FIG. 18 is a view showing an operation panel and a circuit configuration; and

FIG. 19 is a view illustrating backlash,

FIGS. 20 and 21 show another embodiment of the present invention, in which:

FIG. 20 is a front view schematically showing the main part; and

FIG. 21 is a sectional view of a developing unit, and

FIGS. 22 to 25 show an example in which the present invention is applied to a multiple copying machine, in which:

FIG. 22 is a longitudinal, sectional, front view schematically showing a copy mode of the multiple copying machine;

FIG. 23 is a longitudinal, sectional, front view schematically showing a developing device selection mode of the multiple copying machine;

FIG. 24 is a view showing an operation panel and a circuit configuration; and

DETAILED DESCRIPTION OF THE PREFERRED EMBODIMENTS

An image forming apparatus according to one embodiment of the present invention will be described hereinafter with reference to FIGS. 7 to 19.

Figure 8:
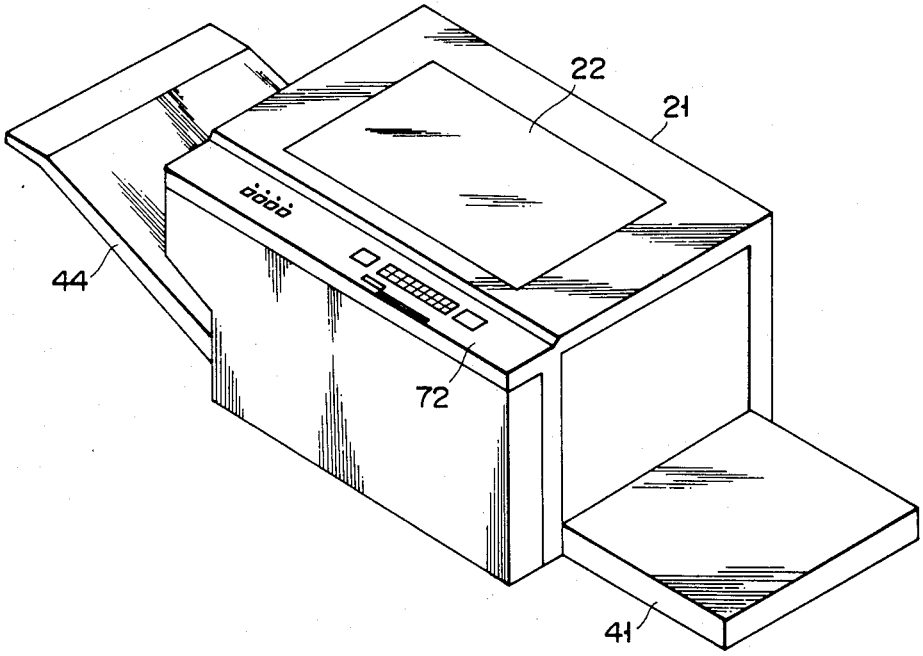
Figure 9:
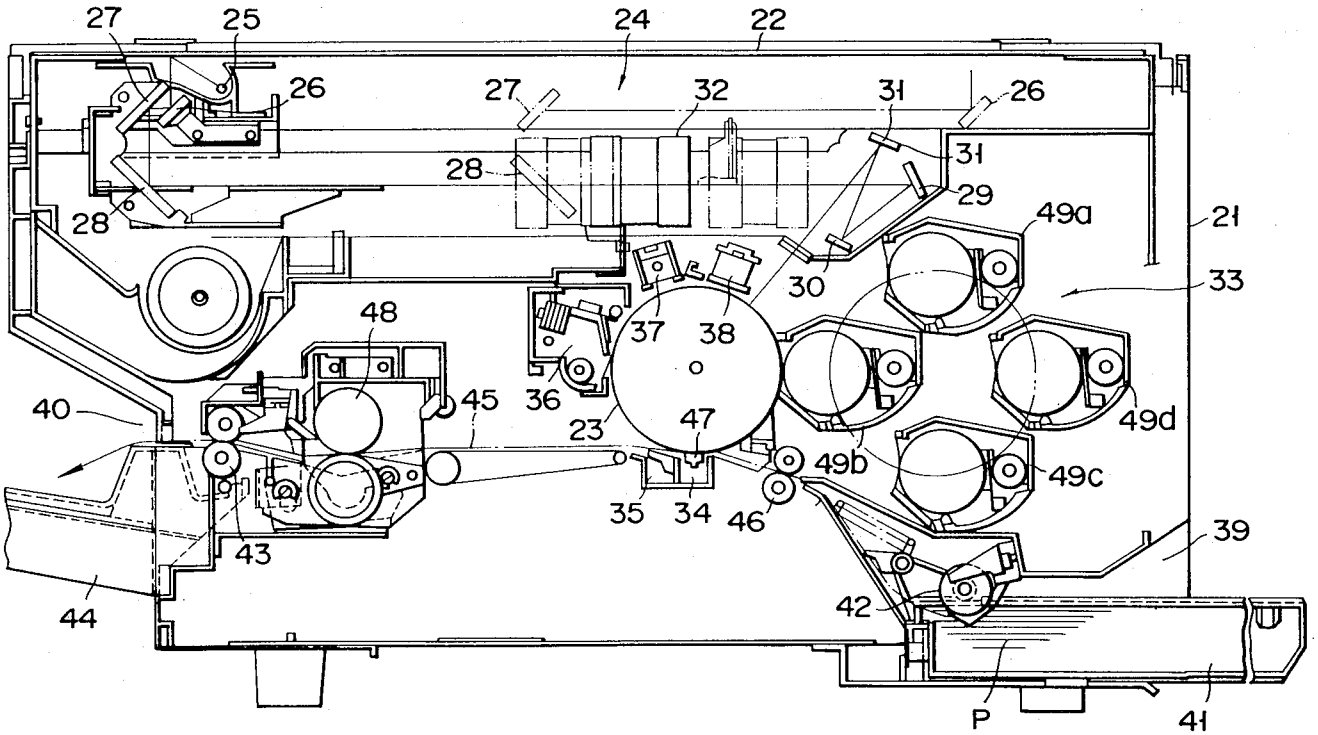

Referring to FIGS. 8 and 9, reference numeral 21 denotes the housing of the multicolor copying machine used as the image forming apparatus according to the present invention. A document table 22 is provided at an upper portion of the housing 21. A photosensitive drum 23 which rotates in a predetermined direction is axially supported at substantially a central portion in the housing 21. An exposure optical system 24 is provided between the drum 23 and the table 22.

In the optical system 24, a scanning lamp 25 and a scanning mirror 26 scan an original placed on the table 22, at a predetermined speed, and guide mirrors 27 and 28 reciprocate back and forth synchronously with rotation of the drum 23 at a speed ½ that of the mirror 26, so as to maintain a constant optical path length. The document on the table 22 is illuminated by the lamp 25, and reflected light therefrom is guided onto the drum 23 through the mirrors 26 to 31 and a lens 32, thus forming a latent image thereon. A developing unit (to be described later in detail) 33, a transfer charger 34, a peeling charger 35, a cleaning unit 36, a discharge lamp 37 and a charger 38 are disposed near the drum 23 along the rotating direction of the drum 23 in the order given.

A paper feed unit 39 and a paper discharge unit 40 are provided at two sides of a bottom of the housing 21, respectively. The unit 39 is constituted of a paper feed cassette which stores paper sheets p, and a paper feed roller 42 for feeding the sheets p from the cassette 41. The unit 40 is constituted of a paper discharge roller 43 and a paper discharge tray 44.

Furthermore, a conveyor path 45 for conveying the sheet p in substantially a horizontal position is provided on the bottom portion of the housing 21. The path 45 sequentially conveys the sheets p fed from the unit 39 to the unit 40 through register rollers 46, a transfer portion 47, defined between the drum 23 and the chargers 34 and 35, and a fixing unit 48.

In the copying machine, the drum 23 is uniformly charged to a predetermined potential by a corona discharge from the charger 38, and thereafter, is exposed, by the optical system 24, with a light including an image impression of the original, thereby forming, on the drum 23, an electrostatic latent image corresponding to the image impression of the original. The latent image is developed by applying to it toner from the unit 33, so as to form a toner image. The toner image is then transferred to one surface of the sheet p by the charger 34. The sheet p on which the toner image is transferred is peeled from the drum 23 by the charger 35, and the toner image is fixed by the fixing unit 48. Thereafter, the sheet p is discharged onto the tray 44. Residual toner on the drum 23 which is not transferred onto the sheet p is removed by the unit 36, and the surface of the drum 23 from which the residual toner is removed is uniformly discharged by the lamp 37, thus preparing for the next copying process.

Figure 10:
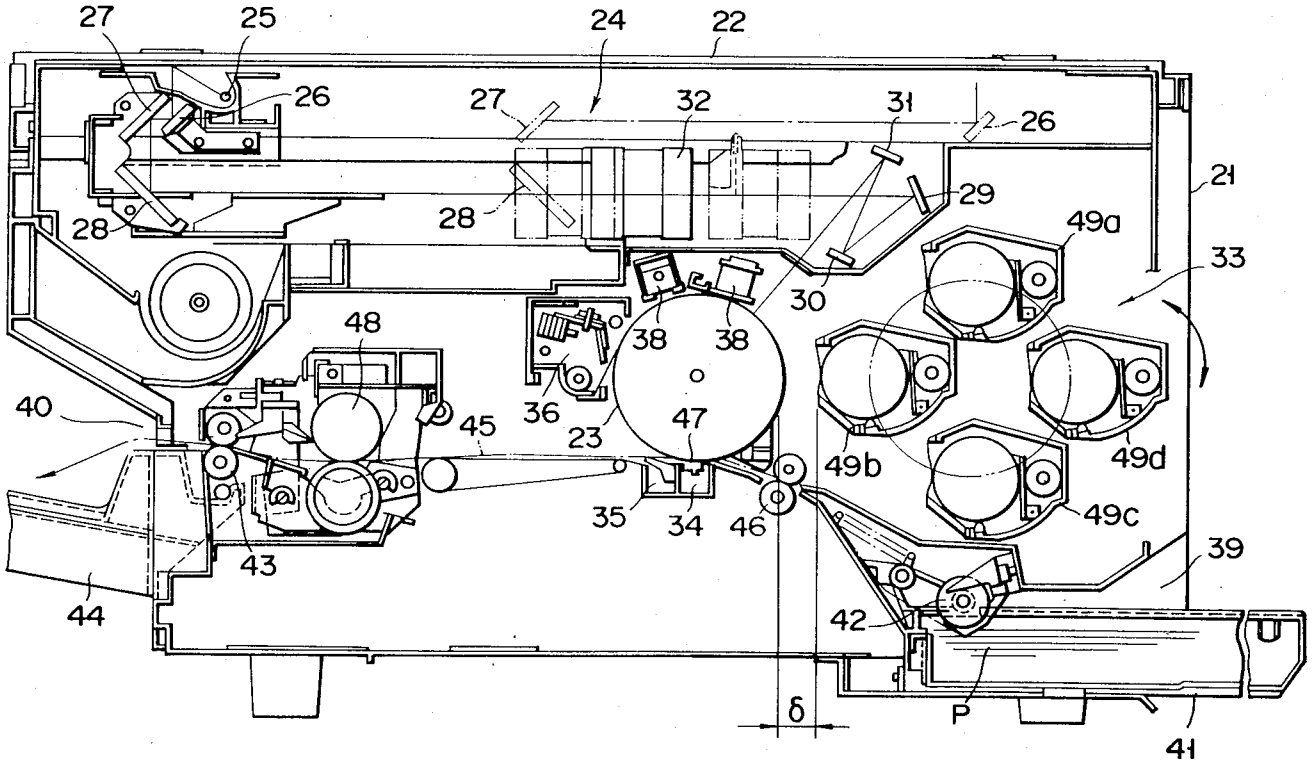

The developing unit 33 comprises four developing devices 49*a* to 49*d*. When these devices 49*a* to 49*d* are revolved in parallel with each other, the desired developing device (e.g., the device 49*d*) can be selected. Directionwise, the unit 33 can be moved to the left and to the right (i.e., a direction approaching and/or moving away from the drum 23). That is, in the copy mode as shown in FIG. 9, the selected developing device, e.g., 49*b* is set near to and facing the drum 23. Meanwhile, when selection of one the devices 49*a* to 49*d* is being made, the unit 33 is moved to a position away from the drum 23 by a predetermined distance $\delta$, as shown in FIG. 10, and one of the devices 49*a* to 49*d* is selected when unit 33 is at this position. When selection is completed, the unit 33 is moved toward the drum 23 and the selected device, e.g., 49*d* is set to face the drum 23.

Figure 11:
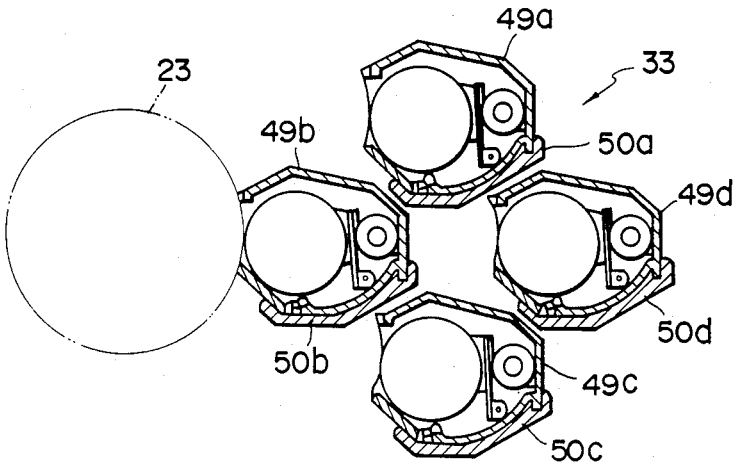
Figure 12:
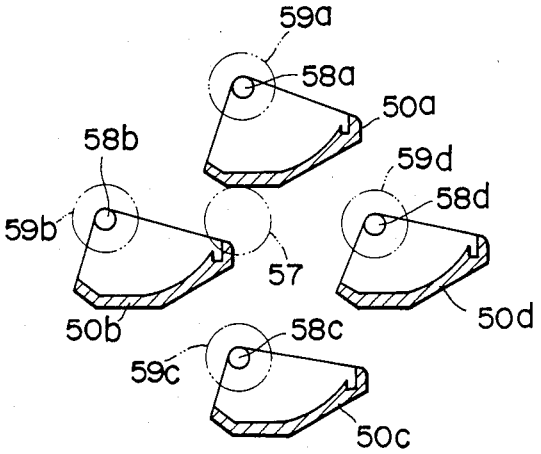

Furthermore, the unit 33 has four developing device receptors 50*a* to 50*d*, as shown in FIGS. 11 and 12. These receptors 50*a* to 50*d* are set in the devices 49*a* to 49*d*, respectively. In this embodiment, for example, the device 49*a* stores black toner, the device 49*b* stores red toner, the device 49*c* stores green toner, and the device 49*d* stores blue toner, respectively.

Figure 13:
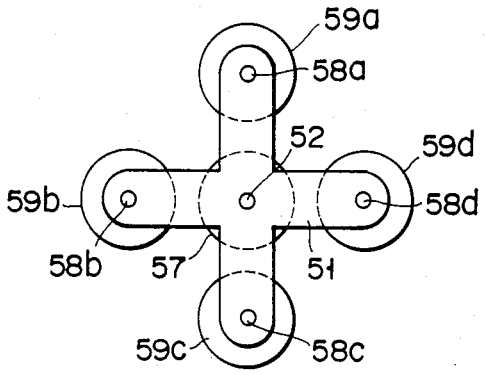
Figure 14:
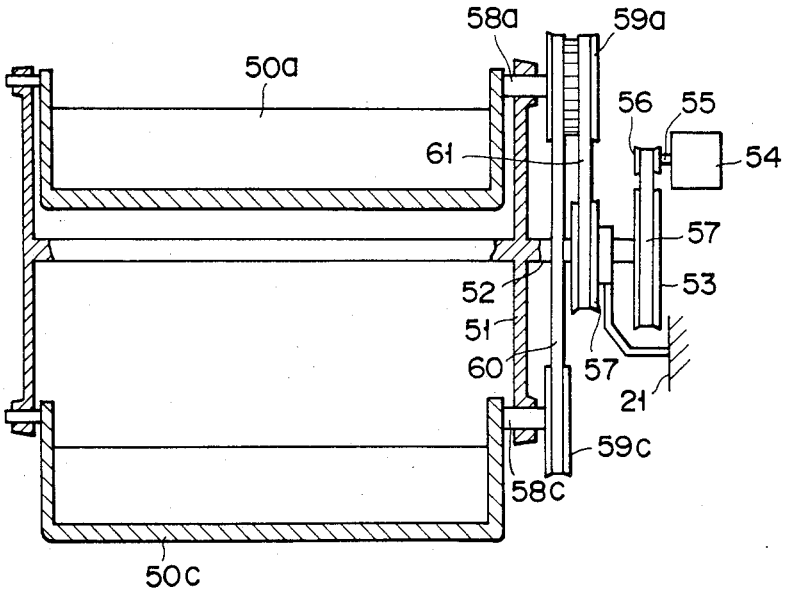

As shown in FIGS. 13 and 14, the receptors 50*a* to 50*d* are provided at the distal ends of a cross-shaped rotating frame (rotating member) 51, respectively. A shaft 52 projects from the central portion of the frame 51. A pulley 53 is fixed to the shaft 53. A timing belt (toothed belt) 57 is looped between the pulley 53 and a pulley 56 fixed to a rotating shaft 55 of a pulse motor 54. When a drive force from the motor 54 is transmitted to the shaft 52, the frame 51 is rotated.

Figure 1:
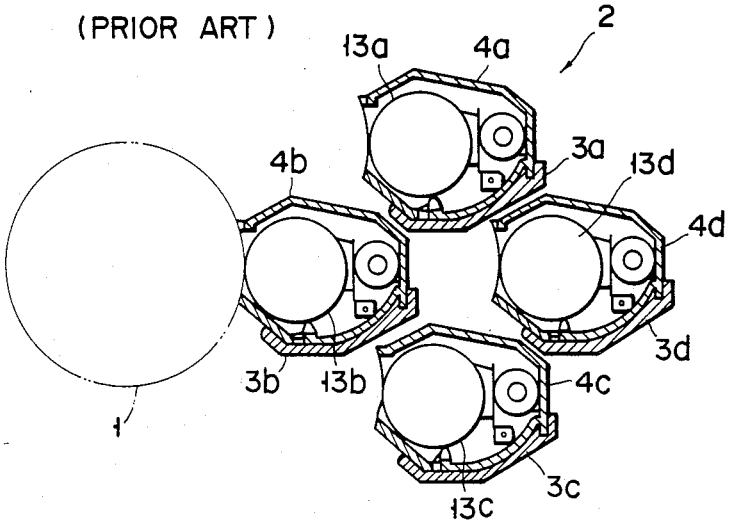
FIG. 1 (PRIOR ART)
Figure 2:
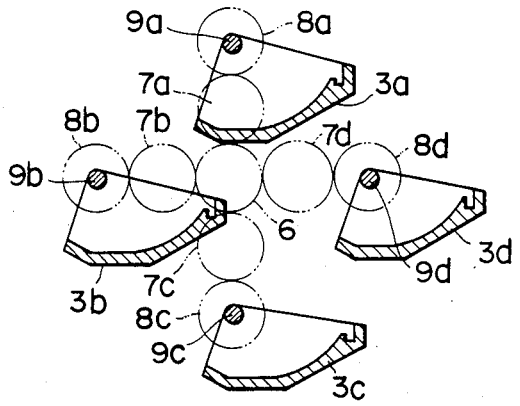
FIG. 2 (PRIOR ART)
Figure 3:
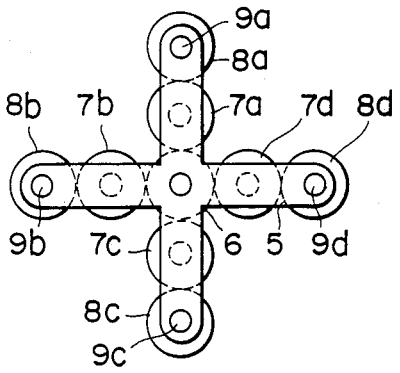
FIG. 3 (PRIOR ART)
Figure 4:
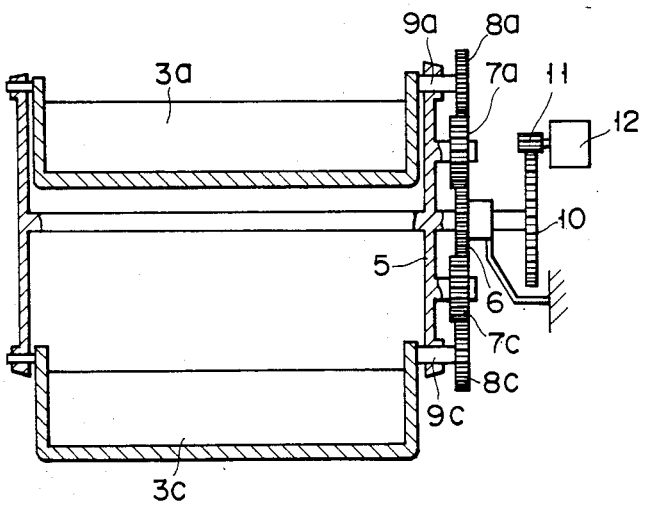
FIG. 4 (PRIOR ART)
Figure 5:
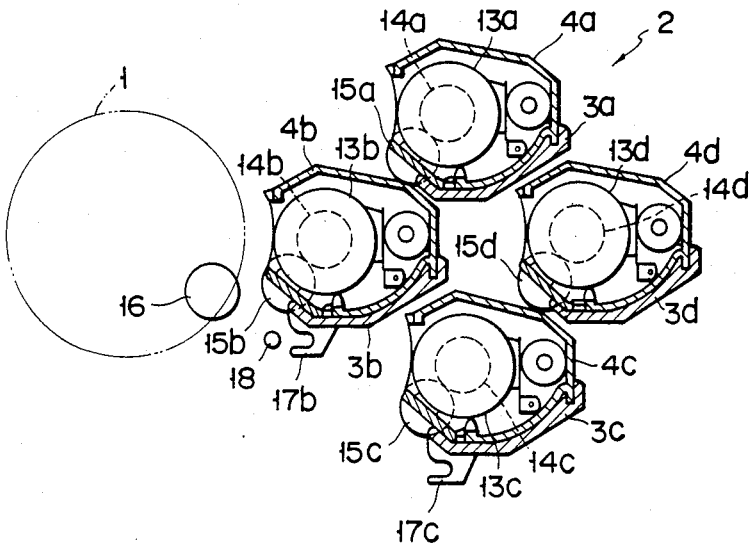
FIG. 5 (PRIOR ART)
Figure 6:
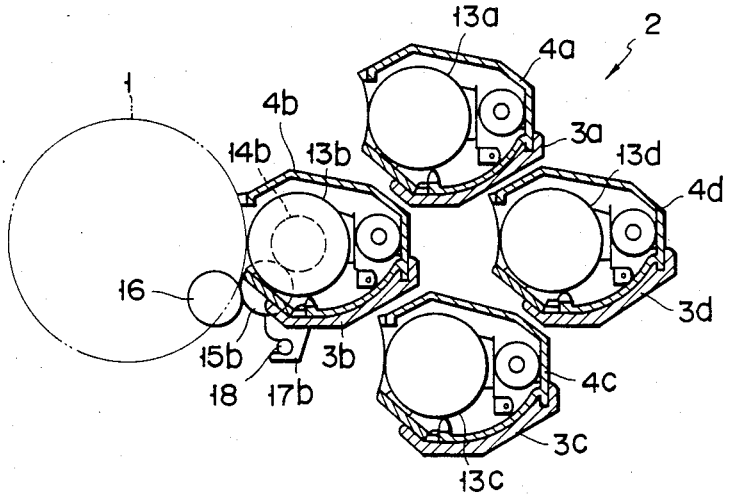
FIG. 6 (PRIOR ART)
Figure 7:
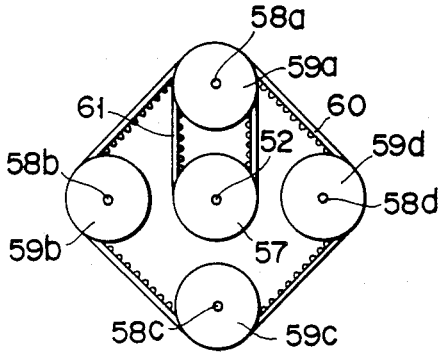

A stationary pulley 57 is fitted around the shaft 52. The pulley 57 is rotatable with respect to the shaft 52 but is stationary with respect to the housing 21. That is, when the frame 51 is rotated, the pulley 57 is not rotated. The receptors 50*a* to 50*d* are rotatably mounted at the distal ends of the frame 51. Planet pulleys (revolution pulleys) 59*a* to 59*d* are fixed to rotating shafts 58*a* to 58*d* of the receptors 50*a* to 50*d*, respectively. As shown in FIG. 7, a timing belt (toothed belt) 60 is looped between the pulleys 58*a* to 58*d*, and a timing belt (toothed belt) 61 is looped between the pulley 59*a* and the pulley 57.

The pulleys 57 and 59*a* to 59*d* have the same outer diameter. When the frame 51 is rotated, the pulleys 59*a* to 59*d* (the devices 49*a* to 49*d*) are not rotated but revolved. For this reason, the receptors 50*a* to 50*d* (the devices 49*a* to 49*d*) are revolved parallel with each other. This movement is required because the devices 49*a* to 49*d* store toner powder.

Figure 15:
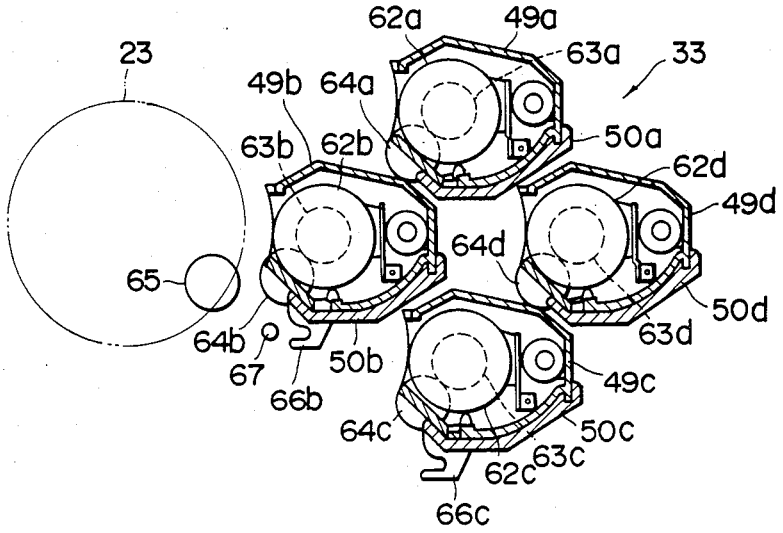
Figure 16:
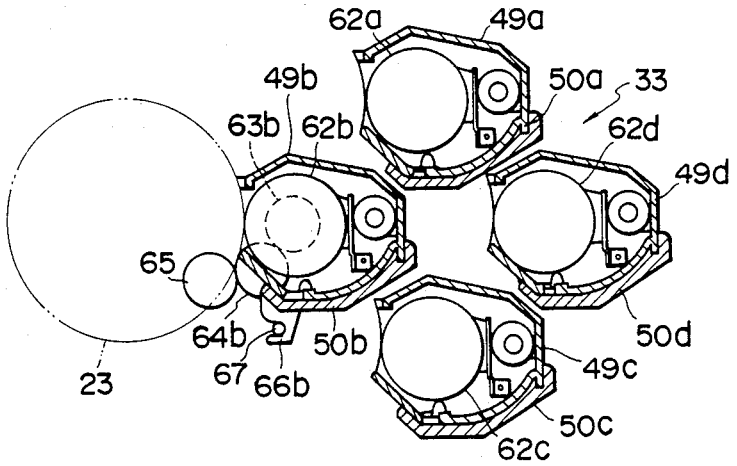

As shown in FIG. 15, the devices 49*a* to 49*d* have developing device gears 63*a* to 63*d* and idle gears 64*a* to 64*d* for driving developing rollers 62*a* to 62*d*, respectively, while the devices 49*a* to 49*d* are themselves driven by a drive gear 65 provided at the side of the housing 21. When the unit 33 approaches the drum 23, the gear 65 is meshed with the idle gear, e.g., 64*b*, and a drive force is transmitted to the gear 63*b* through the gears 65 and 64*b*.

Guide members 66*a* to 66*d* (only members 66*b* and 66*c* are shown) are fixed to the receptors 50*a* to 50*d*, respectively, and a guide pin 67 is fixed to the side of the housing 21 so as to make it engage with any of the members 66*a* to 66*d*. Upon their engagement, the unit 33 can be smoothly and precisely guided when approaching the drum 23, and the precise positional relationship between the drum 23 and the selected developing device can be obtained.

Figure 17:
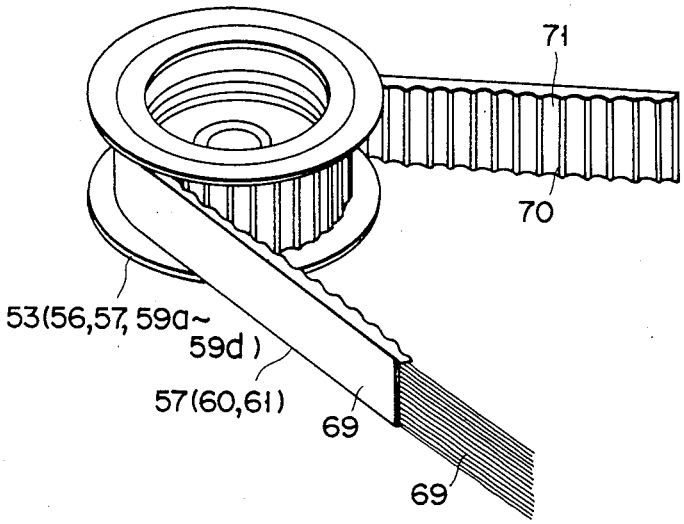

The timing belts 60 and 61 have round teeth, and each comprises a glass fiber tensile member 68, a neoprene back portion 69, a neoprene tooth portion 70 and a nylon coating portion 71 as shown in FIG. 17.

Figure 18:
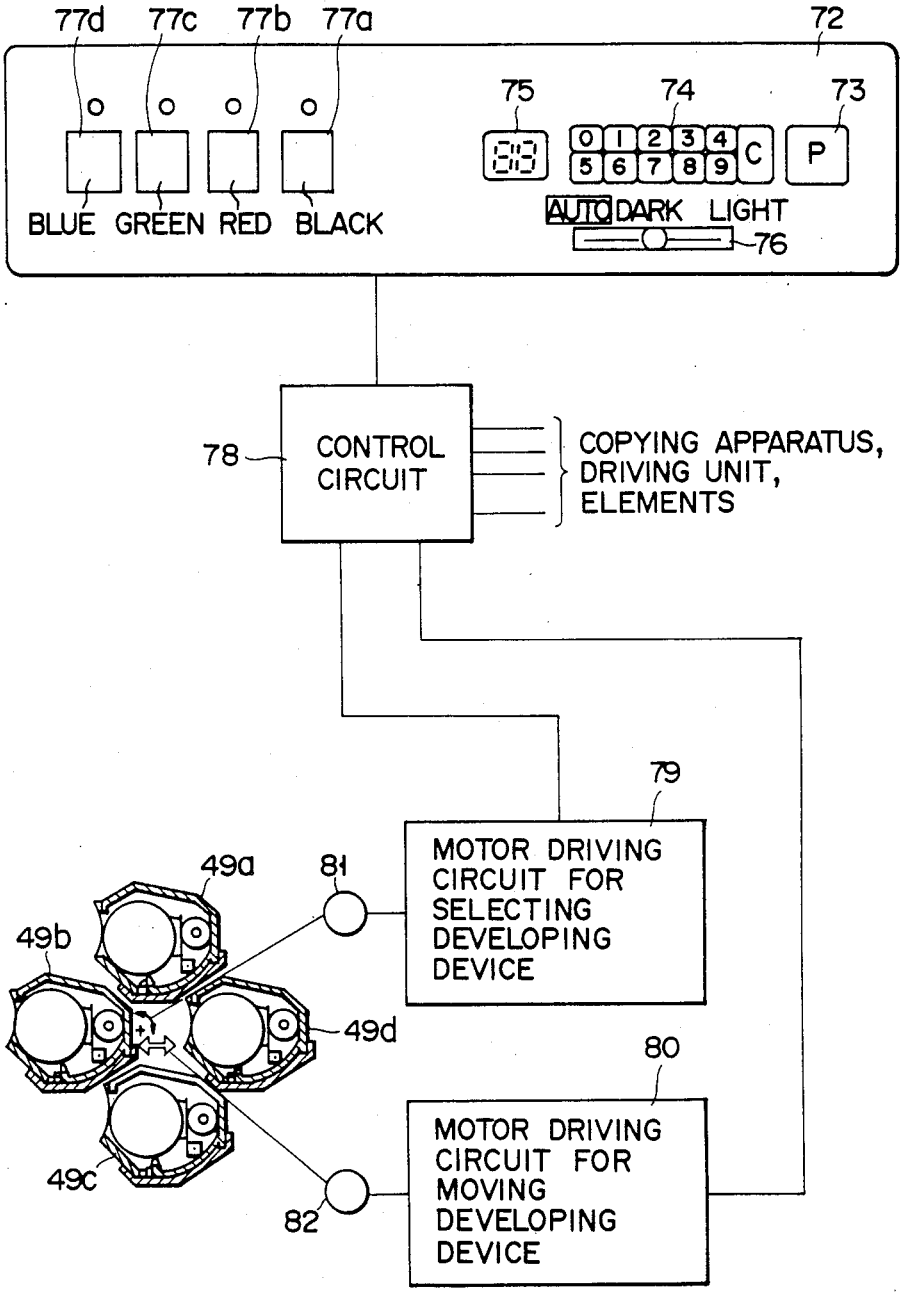
Figure 19:
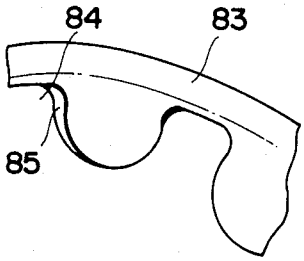

An operation panel 72 is provided at an upper front portion of the housing 21. On the panel 72, a copy key 73 for supplying a copy instruction, ten keys 74 for setting the number of copies and the like, a display 75 for displaying the preset number or the copied number of sheets, a density setting device 76 for setting the copy density, and color selection keys 77*a* to 77*d*, corresponding to the devices 49*a* to 49*d*, are provided as shown in FIG. 18. The key 77*a* is used for selecting black (the device 49*a*); the key 77*b*, red (the device 49*b*); the key 77*c*, green (the device 49*c*); and the key 77*d*, blue (the device 49*d*), respectively. Selection signals from the keys 77*a* to 77*d* are supplied to motor driving circuits 79 and 80 respectively for selecting and moving a developing device through a control circuit 78, thereby driving motors 81 and 82 respectively for selecting and moving the developing device.

The operation of the apparatus with the above arrangement will be described hereinafter. A document is set on the table 22, and a desired copy color is selected by the keys 77*a* to 77*d*. Assume that the key 77*b* is depressed to perform a red copy operation. Upon reception of the red selection signal, the control circuit 78 supplies an ON signal for the motor 82 to the circuit 80 in order to select the device 49*b* storing the red toner corresponding to the key 77*b*. In response to this, the circuit 80 drives the motor 82 so that the unit 33 is moved in a direction away from the drum 23 (i.e., to the right), thus setting the unit 33 in the state shown in FIG. 10.

In this manner, when movement of the unit 33 is completed, the circuit 78 supplies an ON signal for the motor 81 to the circuit 79. In response to this signal, the circuit 79 drives the motor 81 so as to rotate the frame 51, thereby revolving the devices 49*a* to 49*d* while keeping them parallel to each other. When the selected device 49*b* faces the drum 23, revolution is stopped.

Thereafter, the circuit 78 supplies the ON signal for the motor 82 to the circuit 80, thereby moving the unit 33 toward the drum 23. As shown in FIG. 9, the unit 33 is set so that the device 49*b* is near to and facing the drum 23. One of the devices 49*a* to 49*d* must be selected at a position a predetermined distance from the drum 23, both because the devices 49*a* to 49*d* must be precisely aligned with respect to the drum 23 and because the devices 49*a* to 49*d* must be revolved in an area other than that near the drum 23 where insufficient vertical space exists for their revolution. In this position, the red copying operation is enabled. When an operator depresses the key 73 on the panel 72, the above-mentioned red copying operation is started using the device 49*b*.

With the above arrangement, since a revolution timing of the devices 49*a* to 49*d* is taken by the belts 57, 60 and 61, the devices 49*a* to 49*d* can be smoothly revolved without noise. In addition, no backlash occurs. In this case, "backlash" refers to a gap (clearance) 85 between the teeth of the belt 83 and the pulley 84 when they are meshed with each other.

Figure 20:
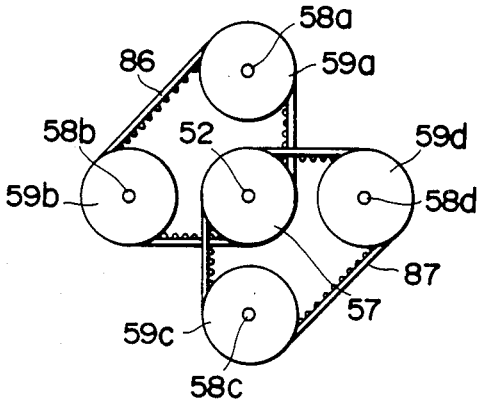
Figure 21:
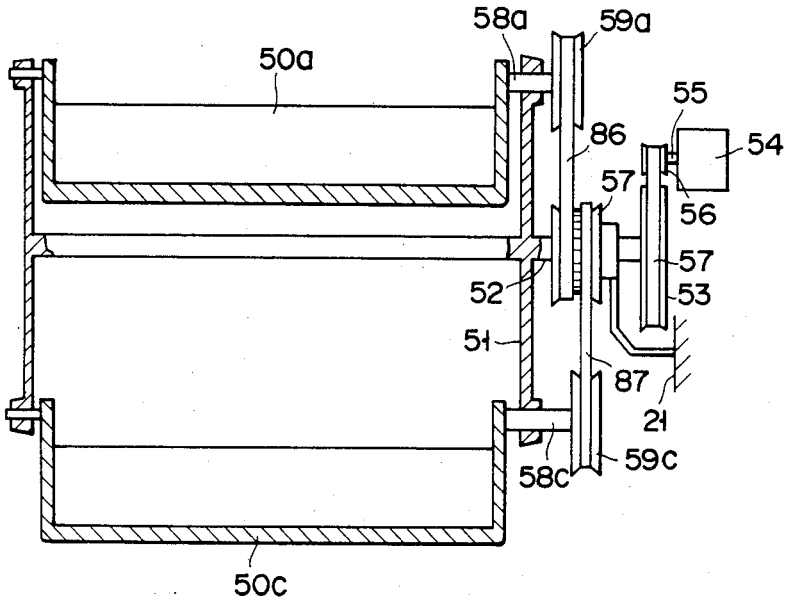

FIGS. 20 and 21 show another embodiment of the selection means according to the present invention. A timing belt 86 is looped between a stationary pulley 57 and two planet pulleys 59*a* and 59*b*, and a timing belt 87 is looped between the pulley 57 and two other planet pulleys 59*c* and 59*d*. With this arrangement, timing belts having the same size can be effectively used.

Figure 22:
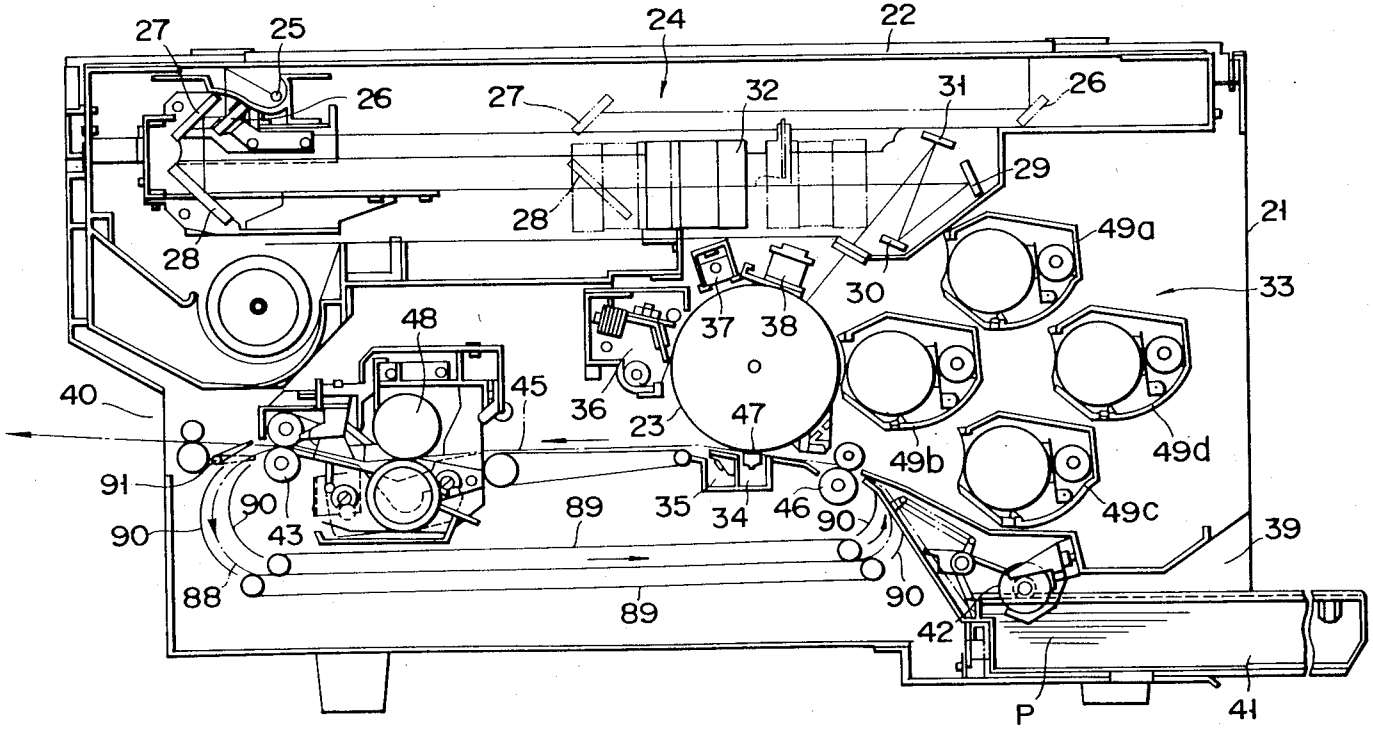
Figure 23:
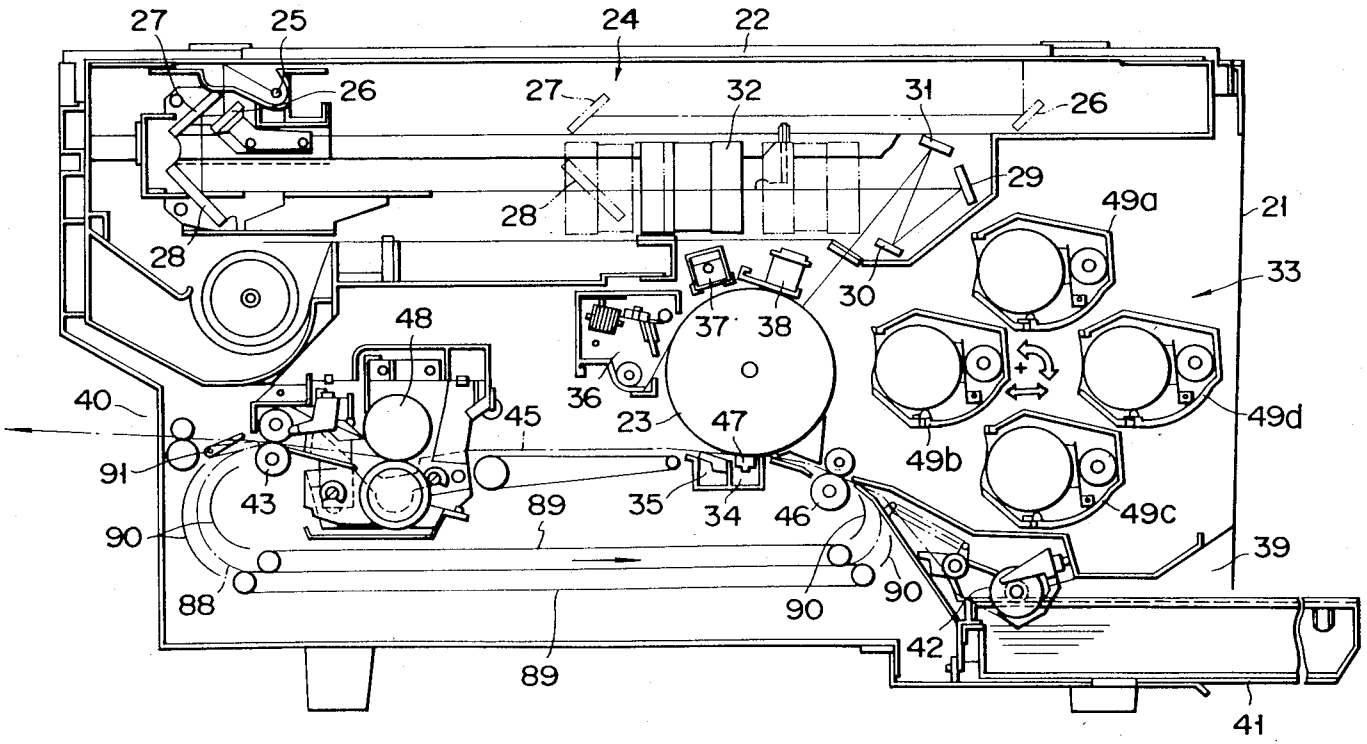
Figure 24:
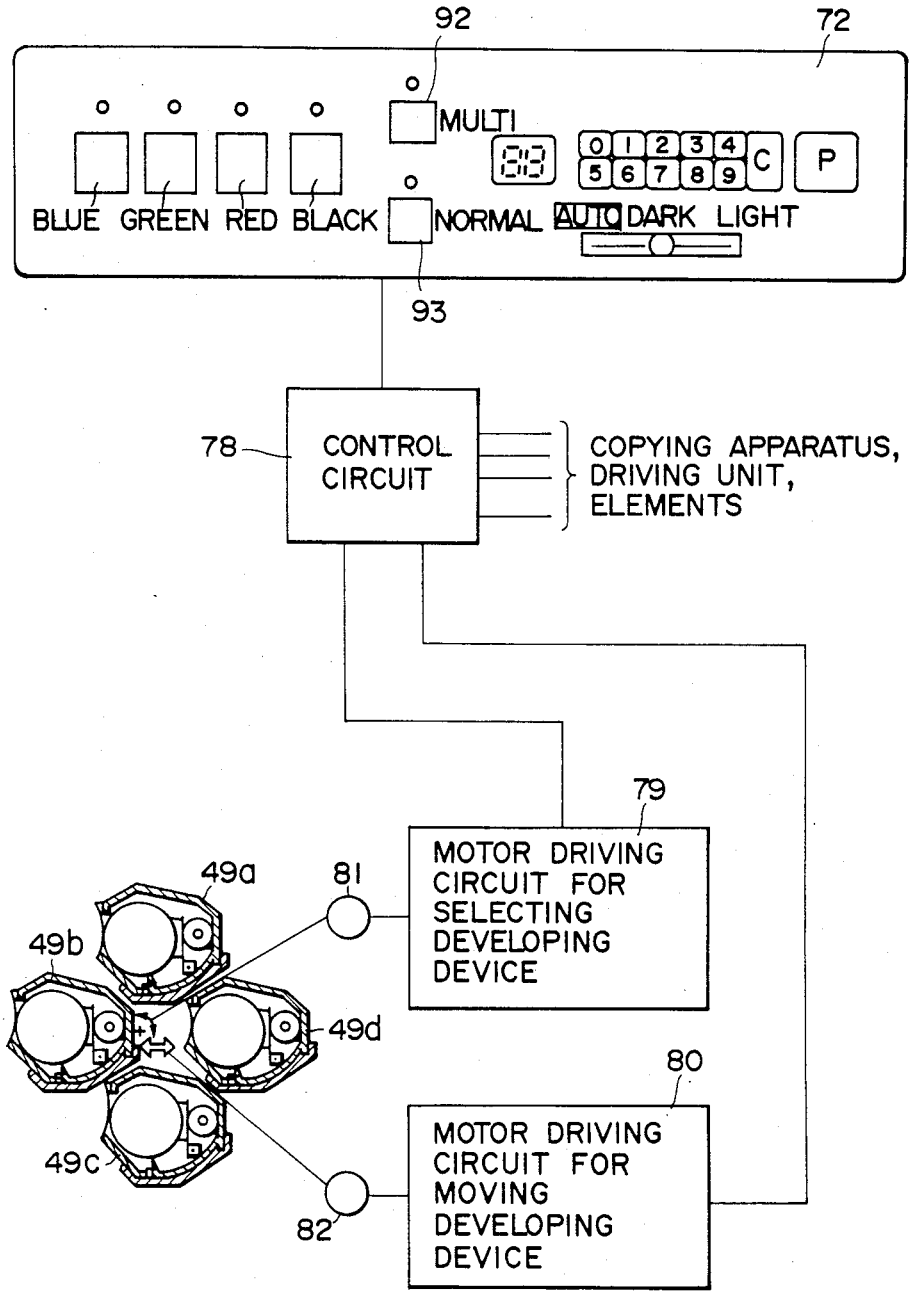
Figure 25A:
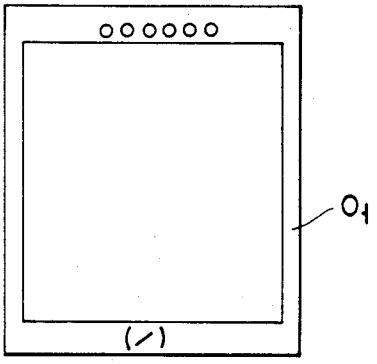
FIGS. 25A and 25B are views illustrating the overlap copy mode.
Figure 25B:
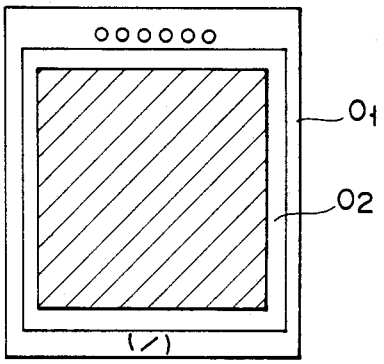

FIGS. 22 to 25 show a multiple copying machine to which the present invention is applied. Only differences between the application of the invention to this machine and that of the above embodiment will be described. As shown in FIGS. 22 and 23, a paper conveyor path 88 for re-feeding a copy paper p on which a toner image has been transferred is provided in a lower portion of the housing 21. The path 88 branches from the conveyor path 45 at the downstream side of the fixing unit 48 and merges to the upstream side of the register rollers 46, and is formed into an annular shape by conveyor belts 89, guides 90 and the like. A selector gate 91 is provided at a branch of the path 88. A multiple key 92 for designating a multiple copy mode, and a normal key 93 for cancelling the multiple copy mode and designating a normal copy mode are added to the panel 72.

The operation of the apparatus with the above arrangement will be explained hereinafter. Upon depression of the key 92 on the panel 72, the control circuit 78 sets the multiple copy mode in response to a signal therefrom. Then, a first original o1 is set on the table 22, and a desired copy color is designated by the keys 77*a* to 77*d*. For example, the key 77*b* is depressed to perform the red copying operation. Thus, in response to this, the circuit 78 supplies an ON signal for the motor 82 to the circuit 80 in order to select the device 49*b*, storing red toner and corresponding to the key 77*b*. Upon reception of this signal, the circuit 80 drives the motor 82 so as to move the unit 33 in a direction away from the drum 23 (to the right), thereby setting the unit 33 in the state shown in FIG. 23.

After movement of the unit 33 is completed, the circuit 78 supplies an ON signal for the motor 81 to the circuit 79. In response to this signal, the circuit 79 drives the motor 81 so as to rotate the frame 51. Thus, the devices 49*a* to 49*d* are revolved while being kept parallel to each other. When the selected device 49*b* faces the drum 23, revolution of the devices is stopped. Thereafter, the circuit 78 again supplies the ON signal for the motor 82 to the circuit 80, thereby moving the unit 33 toward the drum 23. As shown in FIG. 22, the selected device 49*b* is set so as to oppose the drum 23. In this position, the red copy mode is enabled.

When the key 73 on the panel 72 is depressed, the red copying operation using the device 49*b* is started. The copied sheet p passes through the unit 48, and then is guided onto the path 88 from the path 45 by the gate 91. The sheet p is conveyed in front of the rollers 46 by the path 88, and is temporarily stopped at this position, thus preparing for a copying operation using another color.

Having removed the first original o1, a second original o2 is set. In order to cancel the multiple copy mode, the key 92 is depressed. Therafter, in order to set and enable, for example, a black copy mode, the key 77*a* is depressed so as to select the device 49*a* storing the black toner. Note that when the multiple copy mode is to be continued, the key 92 need not be depressed to set the same multiple copy mode.

When the copy key 73 is depressed again, thin time in the black copy mode, the same copying operation as described above is started, thereby carrying out the black copying operation using the device 49*a*. In this case, a black image is formed to overlap a red image formed in the previous red copy mode. When the multiple copy mode is cancelled, the copied sheet p subjected to the multiple copy operation passes through the gate 91 and is discharged on the tray 44. In this manner, the multiple copy operation can be performed. Thus, the originals o1 and o2 can be copied in different colors to overlap each other. If the multiple copy mode is kept set, blue and green images can be formed to overlap the red and black images.

As described above, according to the present invention, an image forming apparatus comprises a housing, at least two developing devices provided in the housing and a selection means for selecting one developing device by revolving the developing devices parallel to each other, wherein the selection means is constituted of a stationary pulley provided in the housing, a rotating member for pivotally supporting and revolving the developing devices, revolving pulleys stationary with respect to the developing devices, and a toothed belt looped between the revolving and stationary pulleys. Therefore, the developing devices can be smoothly replaced without causing noise, backlash, and the like.

What is claimed is:

1. An image forming apparatus comprising:

a housing;

an image carrier provided in the housing, and carrying a latent image on the surface thereof;

developing means for developing the latent image on the surface of the image carrier, said developing means including at least two developing devices which alternatively develop the latent image; and supporting means for supporting said developing devices while keeping said developing devices parallel to each other, and for selectively causing one of said developing devices to oppose said image carrier, said supporting means including a rotating member rotatable about a first rotating shaft, said rotating member supporting said developing devices which are to be rotated about a plurality of second rotating shafts disposed around said first rotating shaft;

a stationary pulley fixed to said rotating member as to be coaxial with said first rotating shaft;

a revolving pulley fixed to each of said developing devices so as to be coaxial with each of said second rotating shafts; and toothed belts looped between said revolving pulleys and said stationary pulley.

2. The image forming apparatus according to claim 1, wherein said toothed belt comprises a timing belt having round teeth.

3. The image forming apparatus according to claim 2, wherein said toothed belts include a first, endless, toothed belt looped between said stationary pulley and one of said revolving pulleys, and a second, endless, toothed belt looped between all of said revolving pulleys.

4. The image forming apparatus according to claim 2, wherein said toothed belts include a first, endless, toothed belt looped between said stationary pulley and at least one revolving pulley, and a second, endless, toothed belt looped between said stationary pulley and said revolving pulleys, excluding said at least one revolving pulley around which said first, endless, toothed belt is looped.

5. The image forming apparatus according to claim 4, wherein said second rotating shafts are disposed so as to be separated at equal distances from said first rotating shaft.

6. The image forming apparatus according to claim 5, wherein said first and second endless, toothed belts have the same length.

* * * * *